US009796008B2

(12) United States Patent
Zhang et al.

(10) Patent No.: US 9,796,008 B2
(45) Date of Patent: Oct. 24, 2017

(54) METHOD FOR PRODUCING BAND STEEL WITH DIFFERENT TARGET THICKNESSES ALONG LONGITUDINAL DIRECTION USING HOT CONTINUOUS ROLLING MILL SET

(71) Applicant: BAOSHAN IRON & STEEL CO., LTD., Shanghai (CN)

(72) Inventors: Yong Zhang, Shanghai (CN); Xingze Zhou, Shanghai (CN); Xuyi Shan, Shanghai (CN); Konglin Zhu, Shanghai (CN); Wenwang Meng, Shanghai (CN); Chuanguo Zhang, Shanghai (CN); Houjun Pang, Shanghai (CN); Zhiling Gao, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 256 days.

(21) Appl. No.: 14/439,956

(22) PCT Filed: Nov. 30, 2012

(86) PCT No.: PCT/CN2012/001602
§ 371 (c)(1),
(2) Date: Apr. 30, 2015

(87) PCT Pub. No.: WO2014/067037
PCT Pub. Date: May 8, 2014

(65) Prior Publication Data

US 2015/0298186 A1 Oct. 22, 2015

(30) Foreign Application Priority Data

Oct. 31, 2012 (CN) ..... 2012 1 0426936

(51) Int. Cl.
*B21B 1/26* (2006.01)
*B21B 37/16* (2006.01)
*B21B 37/58* (2006.01)

(52) U.S. Cl.
CPC ..... *B21B 37/165* (2013.01); *B21B 1/26* (2013.01); *B21B 37/16* (2013.01); *B21B 37/58* (2013.01);
(Continued)

(58) Field of Classification Search
CPC ..... B21B 37/165; B21B 37/16; B21B 37/58; B21B 1/26; B21B 2205/02
See application file for complete search history.

(56) References Cited

U.S. PATENT DOCUMENTS 3,762,195 A 10/1973 Kitanosono et al.

FOREIGN PATENT DOCUMENTS

CN 1333093 1/2002
CN 1850375 10/2006
(Continued)

*Primary Examiner* — Teresa M Ekiert
(74) *Attorney, Agent, or Firm* — Eversheds Sutherland (US) LLP

(57) ABSTRACT

The present invention relates to a method for producing hot rolled strip steel, especially the producing method of hot rolled strip steel with multiple target thicknesses in the longitudinal direction. It is a method to produce the strip steel with different target thicknesses in the longitudinal direction by using a hot continuous rolling mill. In this method, the first equal-thickness section of the strip steel is controlled with the conventional thickness control strategy, while other equal-thickness sections and the transition section between equal-thickness sections are controlled with the variable-thickness control strategy. Under the variable-thickness control strategy, the length of the first section of strip steel, the variation of thickness target value, the rolling stability and the spacing between stands are combined to
(Continued)

determine the stand participating in the variable-thickness control, and calculate the roller gap value, as well as the time and speed of the variation of roller gap, thus achieving the producing control of strip steel with different target thicknesses in the longitudinal direction. The present invention utilizes the length of the first equal-thickness section and the variation of different target thicknesses and other related factors to determine the stands participating in the control, and then distributes the load variation among the stands, thus effectively avoiding the influence on the rolling stability due to imbalance of second flow, so that the produced strip with variable thickness in different sections in the longitudinal direction meet the user's requirements.

7 Claims, 3 Drawing Sheets

(52) U.S. Cl.
CPC ..... *B21B 2205/02* (2013.01); *B21B 2271/02* (2013.01)

(56) References Cited

FOREIGN PATENT DOCUMENTS

| | | |
|---|---|---|
| CN | 101633003 | 1/2010 |
| JP | 2001321813 | 11/2001 |

METHOD FOR PRODUCING BAND STEEL WITH DIFFERENT TARGET THICKNESSES ALONG LONGITUDINAL DIRECTION USING HOT CONTINUOUS ROLLING MILL SET

CROSS-REFERENCE TO RELATED APPLICATIONS

This application claims priority to and benefit of PCT Application No. PCT/CN2012/001602, entitled "Method for Producing Target Strip Steel with Different Thicknesses in the Longitudinal Direction by a Hot Continuous Rolling Mill," filed Nov. 30, 2012, which claims the benefit of Chinese Patent Application No. 201210426936.1 filed on Oct. 31, 2012, which are both incorporated herein by reference in their entirety.

TECHNICAL FIELD

The present invention relates to a method for the production of hot rolled strip steel, especially the production method of hot rolled strip steel with variable thickness in different sections in the longitudinal direction.

BACKGROUND TECHNOLOGY

The variable-thickness plate rolling technology was originated in a Japanese steel company, which started to develop and produce the variable cross-section medium-thickness plate in 1978. Subsequently, French and German steel companies developed variable-thickness plates respectively in the 1980s and 1990s. The development of the variable-thickness rolling technology has been mature in the field of rolling mill for medium-thickness plate.

Most of the existing plate mills are single-stand reversing mills. There does not exist problem of the second flow balance in the process of variable-thickness control. The key point of the variable-thickness is to control the lifting or the depressing of roller gap precisely according to the desired shape, so the variable-thickness control technology of the medium-thickness plate has been developed rapidly. With respect to the medium-thickness plate mill, the conventional hot strip mill is designed to achieve the uniform control of the thickness along the full length of the strip steel, without the capability of the variable-thickness control, so it is more difficult to perform the variable-thickness control on the conventional hot continuous rolling mill.

The conventional hot continuous rolling mill performs control based on the second flow balance. To perform variable-thickness rolling on the conventional hot continuous rolling mill, it is not only required to perform the precise control to the roller gap, but also to perform the control of the timing sequence of the lifting and the depressing of the roller gap of each stand, velocity matching of previous and next stands and the loop stability. It is preferable to avoid the influence on the rolling stability due to the imbalance of the second flow during the thickness varying process. Therefore, it is pretty difficult to perform the precise variable-thickness control on the hot continuous rolling mill. On the other hand, restricted by the user's demands, the application area of the strip still produced with the variable-thickness hot rolling method is very narrow, and most of users need the strip still with uniform thickness, so this technology is developed very slowly in the conventional hot continuous rolling mill.

SUMMARY OF THE INVENTION

The present invention is intended to provide a method to produce the strip steel with different target thicknesses in the longitudinal direction by using a hot continuous rolling mill. In this method, the stands participating in the control are determined according to the length of the first equal-thickness section, the target thickness variation amount, the spacing between stands and the rolling stability after the end stand occludes steel; and then, the load variation amount of all sections of the strip is distributed with equal proportion to the stands participating in the control, and the roller gap is set for several times, thus the precision of the strip steel is ensured.

The invention is applied like this:

A method to produce strip steel with different target thicknesses in a longitudinal direction by using a hot continuous rolling mill, wherein: the target strip steel is roll controlled through two control strategies, an equal-thickness control and an variable-thickness control; wherein a first equal-thickness section of the target strip steel is controlled using the equal-thickness control, which adopts a load distribution method of relative depressing rate, a load which should be withstood by each stand is distributed in the principle of diminishing the load from a front stand to a rear stand along a moving direction of the strip steel; transition sections between each equal thickness section, and other equal-thickness sections adopt the variable-thickness control, when the end stand of the hot continuous rolling mill occludes steel, the variable-thickness control is implemented by following steps:

Step 1 determine stands participating in the variable-thickness control; the variable-thickness control is performed by stands in a rear section of the mill, a start stand participating in the variable-thickness control is determined based on a length of a first equal-thickness section of the strip steel, a target thickness variation amount of each equal-thickness section, a spacing between stands and a rolling stability;

Step 2 determine a load of each stand participating in the variable-thickness control; distribute a load variation amount based on a variation amount between a load of each stand in one front equal-thickness section and a load of each stand in one rear equal-thickness section; and obtain a roller gap value of each stand corresponding to a target thickness of each equal-thickness section according to a conversion relation between a load and the roller gap;

Step 3 determine an action timing sequence of each stand participating in the variable-thickness control; calculate a time during which each stand participating in the variable-thickness control performs changing of the roller gap, to cause each stand acts onto a same position on the target strip steel when performing changing of the roller gap;

Step 4 calculate a variation velocity of the roller gap of each stand participating in the variable-thickness control when controlling the transition section between each equal-thickness section, to complete a production control on the strip steel with different target thicknesses in the longitudinal direction.

A specific method to determine stands participating in the variable-thickness control as described in the Step 1 is given as follows:

Select a stand meeting a condition defined by Formula (1) as the start stand I participating in the variable-thickness control:

$$I = \min\left\{ i,\ i \in \frac{S \times \sum_{n=i}^{(end-1)} h_n}{h_{end}} \le L_1 \right\} \tag{1}$$

wherein:

$h_i$ is a thickness of the strip steel at an outlet of the $i^{th}$ stand;

i is a serial number of the stand;

end is the serial number of an end stand of the hot continuous rolling mill;

$L_1$ is the length of the first equal-thickness section;

S is a distance from the $i^{th}$ stand to the $(i+1)^{th}$ stand, distance between stands of the hot continuous rolling mill is a constant; and $h_{end}$ is a thickness of the strip steel at the outlet of the end stand;

the stands participating in the variable-thickness control include the $i^{th}$ stand to the end stand; for consideration of rolling stability, the stands participating in the variable-thickness control start acting after the end stand occludes steel.

From the point of view of rolling stability, the larger the number of the stands participating in the variable-thickness control is, the more stable the variable-thickness rolling will be, so that the stand with a smallest serial number among all the stands meeting the condition defined by Formula (1) is selected as the start stand.

A specific method to calculate a load of each stand participating in the variable-thickness control in the $k^{th}$ equal-thickness section of the target strip steel as described in the Step 2 is given in Formula (2):

$$T_{ik}=T_{i(k-1)}\times r \tag{2}$$

wherein:

$T_{ik}$ is a load of the $i^{th}$ stand in the $k^{th}$ equal-thickness section of the target strip steel;

$T_{i(k-1)}$ is a load of the $i^{th}$ stand in the $(k-1)^{th}$ equal-thickness section of the target strip steel;

$T_{i1}$ is an initial load of the $i^{th}$ stand in the first equal-thickness section; and r is a variation factor of a load transiting from the $(k-1)^{th}$ equal-thickness section to the $k^{th}$ equal-thickness section, the load variation factor must meet the condition defined in Formula (3):

$$h_{endk} = h_{(i-1)k} \times \sum_{n=l}^{end} (1 - T_{n(k-1)} \times r) \tag{3}$$

wherein:

$h_{endk}$ is a thickness of the strip steel at the outlet of the end stand in the $k^{th}$ equal-thickness section;

$h_{(i-1)k}$ is a thickness of the strip steel at an inlet of the $i^{th}$ stand in the $k^{th}$ equal-thickness section;

end is a total number of the stands in the hot continuous rolling mill; and

I is the start stand participating in the variable-thickness control.

A specific method to calculate the time during which each stand participating in the variable-thickness control performs changing of the roller gap as described in the Step 3 is given in Formula (5):

$$t_i = \frac{S}{v_{(i-1)}} \tag{5}$$

wherein:

$t_i$ is a delay time of the $i^{th}$ stand lifting and depressing the roller gap relative to the $(i+1)^{th}$ stand;

$v_{(i-1)}$ is a moving velocity of the strip steel at the inlet of the $i^{th}$ stand, in m/s; and S is a distance from the $i^{th}$ stand to the $(i+1)^{th}$ stand, distance between stands of the hot continuous rolling mill is a constant;

a roller gap action of the $(i+1)^{th}$ stand must start after the roller gap action of the $i^{th}$ stand stops by delaying $t_i$, so as to ensure each stand acts onto the same position on the strip steel when each stand performs roller gap change.

A specific method to calculate the variation velocity of the roller gap of each stand participating in the variable-thickness control when the transition section between each equal-thickness section is being controlled, as described in the Step 3, is given as follows, formula (6) is used to calculate the variation velocity $v_{igk}$ of the roller gap of the $i^{th}$ stand when the target strip steel is transiting from the $k^{th}$ equal-thickness section to the $k+1^{th}$ equal-thickness section:

$$v_{igk} = \frac{(gap_{ik} - gap_{i(k+1)}) \times v_i}{L_{gk}} \tag{6}$$

wherein:

$gap_{ik}$ is the roller gap of the $i^{th}$ stand in the $k^{th}$ equal-thickness section of the target strip steel;

$gap_{i(k+1)}$ is the roller gap of the $i^{th}$ stand in the $(k+1)^{th}$ equal-thickness section of the target strip steel;

$v_i$ is a moving velocity of the strip steel at the outlet of the $i^{th}$ stand, in m/s; and $L_{gk}$ is a length of the transition section between the $(k+1)^{th}$ equal-thickness section and the $k^{th}$ equal-thickness section.

The moving velocity of the strip at the outlet of the $i^{th}$ stand may be selected based on the following three cases:

1) when calculating the variation velocity of the roller gap of each stand for the target strip steel in a last transition section, a steel throwing velocity is selected as $v_i$;

2) when calculating the variation velocity of the roller gap of each stand for the target strip steel in other transition sections, a threading velocity is selected as $v_i$;

3) in other cases, adopt an actual moving velocity of the strip steel during rolling as $v_i$.

In the invention, a method to produce strip steel with different target thicknesses in a longitudinal direction by using a hot continuous rolling mill, the stands participating in the control are determined according to the length of the first equal-thickness section, the target thickness variation amount, the spacing between stands and the rolling stability after the end stand occludes steel; and then, the load variation amount of respective section of the strip is distributed to the stands participating in the control, and the secondary setting of the roller gap is performed, effectively avoiding the influence on the rolling stability due to imbalance of the second flow; in the specific control, the first equal-thickness section at the head part of the strip steel is not put into the thickness auto-feedback control AGC, and the equal-thickness control on the head part is guaranteed mainly depending on the model setting of the hot continuous rolling mill, while other equal-thickness sections are put into the monitoring AGC function, thus the precision of the strip steel is ensured, so that the produced strip steel with variable thickness by section in the longitudinal direction meets the user's requirements.

DESCRIPTION OF THE PREFERRED EMBODIMENTS

Figure 1:
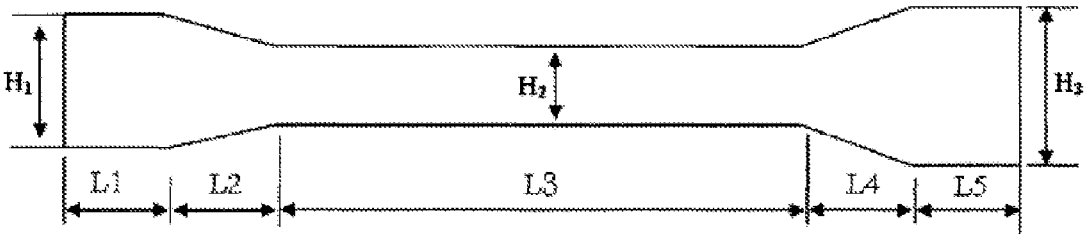
FIG. 1 is the schematic diagram of strip with different target thicknesses in the longitudinal direction produced with the method embodiment to produce the strip steel with different target thicknesses in the longitudinal direction in the invention.
Figure 2:
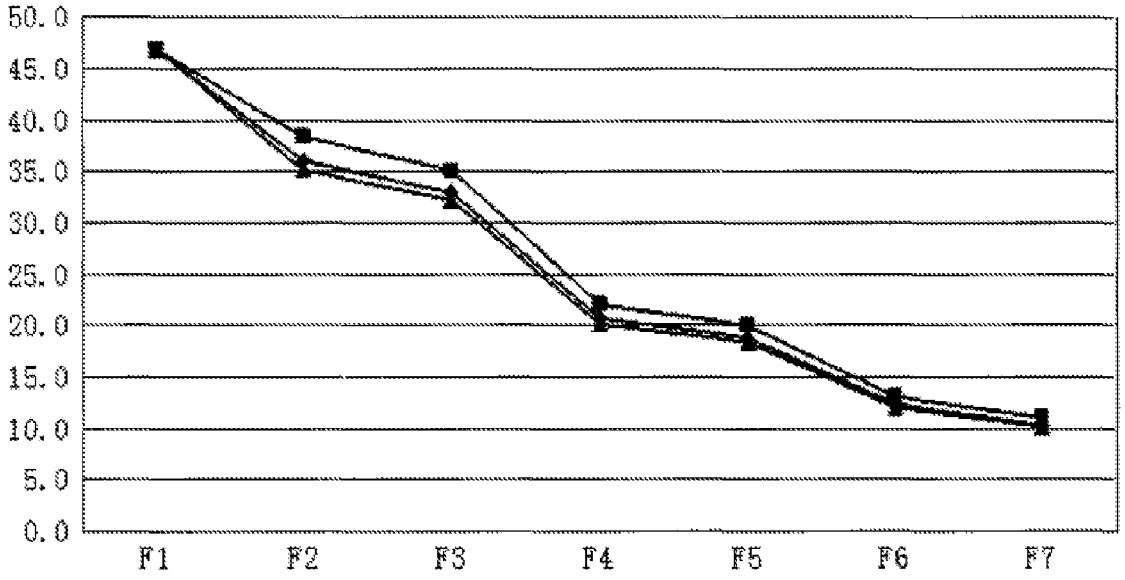
FIG. 2 is the schematic diagram showing the comparison of the loads respectively corresponding to the stands of the first, second and third equal-thickness sections in the embodiment of the invention. -◆- is the load curves of the stands in the first equal-thickness section -■- is the load curves of the stands in the second equal-thickness section; -▲- is the load curves of the stands in the third equal-thickness section; and the vertical coordinate indicates the load values.

Next, we will further describe the invention by combining with the embodiments. It should be understood that these embodiments are merely illustrative of the invention and are not intended to limit the scope of the invention. It should also be understood that, after reading the described contents of the invention, a person skilled in the art can make any change or modification to it, and all these equivalent forms will also fall within the scope defined by the claims attached to the present application.

Embodiment 1

2. A method to produce strip steel with different target thicknesses in the longitudinal direction by using a hot continuous rolling mill; the target strip steel is roll controlled through two control strategies, an equal-thickness control and an variable-thickness control; wherein a first equal-thickness section of the target strip steel is controlled using the equal-thickness control, which adopts a load distribution method of relative depressing rate, a load which should be withstood by each stand is distributed in the principle of diminishing the load from a front stand to a rear stand along a moving direction of the strip steel; transition sections between each equal thickness section, and other equal-thickness sections adopt the variable-thickness control, when the end stand of the hot continuous rolling mill occludes steel, the variable-thickness control is implemented by following steps:

Step 1 determine stands participating in the variable-thickness control; the variable-thickness control is performed by stands in a rear section of the mill, a start stand participating in the variable-thickness control is determined based on a length of a first equal-thickness section of the strip steel, a target thickness variation amount of each equal-thickness section, a spacing between stands and a rolling stability; a specific method to determine stands participating in the variable-thickness control as described in the Step 1 is given as follows:

Select a stand meeting a condition defined by Formula (1) as the start stand I participating in the variable-thickness control:

$$I = \min\left\{ i,\ i \in \frac{S \times \sum_{n=i}^{(end-1)} h_n}{h_{end}} \le L_1 \right\} \tag{1}$$

wherein:

- $h_1$ is a thickness of the strip steel at an outlet of the $i^{th}$ stand;
- i is a serial number of the stand;
- end is the serial number of an end stand of the hot continuous rolling mill;
- $L_1$ is the length of the first equal-thickness section;
- S is a distance from the $i^{th}$ stand to the $(i+1)^{th}$ stand, distance between stands of the hot continuous rolling mill is a constant; and
- $h_{end}$ is a thickness of the strip steel at the outlet of the end stand;

The stands participating in the variable-thickness control include the $i^{th}$ stand to the end stand, in which, the end stand is not needed to be involved in the calculation based on Formula (1), as it always participates in the variable-thickness control; from the point of view of rolling stability, the stands participating in the variable-thickness control start acting after the end stand occludes steel.

From the point of view of rolling stability, the larger the number of the stands participate in the variable-thickness control, the more stable the stands participating in the variable-thickness control will be. Thus, here all of the stands satisfying the Formula (1) are selected as the stands participate in the variable-thickness control.

As shown in FIG. 1, the hot continuous rolling mill utilized in this embodiment is of the 7-stand structure, namely, there are a total of seven stands in the mill: F1, F2, F3, F4, F5, F6, and F7, wherein F1 is the start stand, and F7 is the end stand. The strip steel with different target thicknesses in the longitudinal direction to be produced is divided into strip steel of three equal-thickness sections. The length L1 and the thickness H1 of the first equal-thickness section at the head part of the target strip steel are 50 m and 5.2 mm, respectively, and the length L2 of the first transition section of the target strip steel is 50 m; the thickness H2 and the length L3 of the second equal-thickness section at the medium part of the target strip steel are 4.6 mm and 400 m, respectively, and the length L4 of the second transition section of the target strip steel is 50 m; the length L5 and the thickness H3 of the third equal-thickness section at the end part of the target strip steel is 50 m and 5.4 mm. The roller gap setting values of the respective stands when the first equal-thickness section of the target strip steel is being equal-thickness-controlled are given in Table 1.

TABLE 1

| | Stand | | | | | | |
|---|---|---|---|---|---|---|---|
| | F1 | F2 | F3 | F4 | F5 | F6 | F7 |
| Roller Gap (mm) | 22.3 | 14.6 | 9.9 | 8.1 | 6.8 | 5.4 | 5.5 |

As the thickness of the first section of the strip steel is 5.2 mm, and that of the medium blank is 40 mm, the thickness at the outlet of each stand may be calculated based on the given initial load, as shown in Table 1a:

| | Stand | | | | | | |
|---|---|---|---|---|---|---|---|
| | F1 | F2 | F3 | F4 | F5 | F6 | F7 |
| Thickness at Outlet (mm) | 22.0 | 14.5 | 9.9 | 8.0 | 6.5 | 5.8 | 5.2 |

Table 1a is Thickness of the Strip Steel at the Outlet of Each Stand in the First Equal-Thickness Section When it is calculated based on the conditions that L1=50 m, the distance between stands is 5.8 m and the number of the end stand is 7, the start stand meeting the variable thickness requirement on the length of the first thickness section is:

$$I = \min\left\{ i,\ i \in \frac{S \times \sum_{n=i}^{(end-1)} h_n}{h_{end}} \le L_1 \right\}$$

When i=1, $$l = \frac{5.8 \times (22 + 14.5 + 9.9 + 8.0 + 6.5 + 5.8)}{5.2} = 74.4 > L1$$

Similarly,
When i=2, l=49.7≤L1
When i=3, l=33.7≤L1
When i=4, l=22.6≤L1
When i=5, l=33.8≤L1
When i=6, l=6.4≤L1
Therefore, $$\left\{ i \in \frac{S \times \sum_{n=i}^{(end-1)} h_n}{h_{end}} \le L_1 \right\} = \{2, 3, 4, 5, 6\}$$

According to the above calculation, it is known that: when i is 2, 3, 4, 5 or 6, the requirement on the length of the first thickness can be always met. Therefore, from the point of view of rolling stability, the number of the stands participating in the variable-thickness control needs to be as large as possible, namely, I=min{2, 3, 4, 5, 6}=2. Thus, the second stand to the seventh stand participate in the variable-thickness control.

Step 2 determine a load of each stand participating in the variable-thickness control; distribute a load variation amount based on a variation amount between a load of each stand in one front equal-thickness section and a load of each stand in one rear equal-thickness section; and obtain a roller gap value of each stand corresponding to a target thickness of each equal-thickness section according to a conversion relation between a load and the roller gap; a specific method to calculate a load of each stand participating in the variable-thickness control in the $k^{th}$ equal-thickness section of the target strip steel as described in the Step 2 is given in Formula (2): in the process of calculation, determine the load of each of the subsequent sections based on the initial load value of the first equal-thickness section. The new load value of each section is calculated based on the load value of the adjacent previous section.

$$T_{ik} = T_{i(k-1)} \times r \tag{2}$$

wherein:

$T_{ik}$ is a load of the $i^{th}$ stand in the $k^{th}$ equal-thickness section of the target strip steel;

$T_{i(k-1)}$ is a load of the $i^{th}$ stand in the $(k-1)^{th}$ equal-thickness section of the target strip steel;

$T_{i1}$ is an initial load of the $i^{th}$ stand in the first equal-thickness section; and r is a variation factor of a load transiting from the $(k-1)^{th}$ equal-thickness section to the $k^{th}$ equal-thickness section, the load variation factor must meet the condition defined in Formula (3):

$$h_{endk} = h_{(i-1)k} \times \prod_{n=1}^{end} (1 - T_{n(k-1)} \times r) \tag{3}$$

wherein:

$h_{endk}$ is a thickness of the strip steel at the outlet of the end stand in the $k^{th}$ equal-thickness section;

$h_{(i-1)k}$ is a thickness of the strip steel at an inlet of the $i^{th}$ stand in the $k^{th}$ equal-thickness section;

end is a total number of the stands in the hot continuous rolling mill; and

I is the start stand participating in the variable-thickness control.

On the basis of the load of each section is obtained, the roller gap value of each stand in each equal-thickness section of the target strip steel in the variable-thickness control part is calculated with the roller gap model. The roller gap value of each equal-thickness section is calculated through the formula below:

$$gap_{ik} = \frac{(P_0 - F_{ik})}{M} + h_{ik} \tag{4}$$

Wherein:

$gap_{ik}$ is the roller gap value of the $i^{th}$ stand in the $k^{th}$ equal-thickness section of the target strip steel;

$P_0$ is the zero-adjustment rolling force of the mill; a constant;

$F_{ik}$ is the calculated rolling force of the $i^{th}$ stand in the $k^{th}$ equal-thickness section of the target strip steel;

M is the rigidity factor of the mill; a constant;

$h_{ik}$ is the thickness at the outlet of the $i^{th}$ stand in the $k^{th}$ equal-thickness section of the target strip steel;

The loads of the stands in the equal-thickness section of the target strip steel in this embodiment are given in Table 1b:

TABLE 1b

| | Stand | | | | | | |
|---|---|---|---|---|---|---|---|
| Load | F1 | F2 | F3 | F4 | F5 | F6 | F7 |
| First equal-thickness section (%) | 47.0 | 36.0 | 32.9 | 20.7 | 18.8 | 12.3 | 10.3 |
| Second equal-thickness section (%) | 47.0 | 38.4 | 35.1 | 22.1 | 20.0 | 13.1 | 11.0 |

TABLE 1b-continued

| Load | Stand | | | | | | |
|---|---|---|---|---|---|---|---|
| | F1 | F2 | F3 | F4 | F5 | F6 | F7 |
| Third equal-thickness section (%) | 47.0 | 35.2 | 32.2 | 20.2 | 18.4 | 12.0 | 10.1 |

The roller gap values of the stands in the second equal-thickness section and in the third equal-thickness section of the target strip steel obtained with the roller gap model are respectively given in Table 2 and Table 3.

TABLE 2

Roller gap values of the stands in the second equal-thickness section of the target strip steel

| | Stand | | | | | | |
|---|---|---|---|---|---|---|---|
| | F1 | F2 | F3 | F4 | F5 | F6 | F7 |
| Roller Gap (mm) | 22.3 | 13.5 | 8.9 | 7.1 | 5.9 | 4.6 | 4.6 |

TABLE 3

Roller gap values of the stands in the third equal-thickness section of the target strip steel

| | Stand | | | | | | |
|---|---|---|---|---|---|---|---|
| | F1 | F2 | F3 | F4 | F5 | F6 | F7 |
| Roller Gap (mm) | 22.3 | 15.2 | 10.3 | 8.5 | 7.3 | 5.8 | 5.9 |

Step 3 determine an action timing sequence of each stand participating in the variable-thickness control; calculate a time during which each stand participating in the variable-thickness control performs changing of the roller gap, to cause each stand acts onto a same position on the target strip steel when performing changing of the roller gap. The specific method is as shown in Formula (5).

$$t_i = \frac{S}{v_{(i-1)}} \tag{5}$$

wherein:

$t_i$ is a delay time of the $i^{th}$ stand lifting and depressing the roller gap relative to the $(i+1)^{th}$ stand;

$v_{(i-1)}$ is a moving velocity of the strip steel at the inlet of the $i^{th}$ stand, in m/s; and S is a distance from the $i^{th}$ stand to the $(i+1)^{th}$ stand, distance between stands of the hot continuous rolling mill is a constant;

a roller gap action of the $(i+1)^{th}$ stand must start after the roller gap action of the $i^{th}$ stand stops by delaying $t_i$, so as to ensure each stand acts onto the same position on the strip steel when each stand performs roller gap change.

Wherein, the time at which the roller gap of the first stand participating in the variable-thickness control starts to change is determined by adding the delay time T after the end stand occludes steel. The delay time T is:

$$T = \frac{L_1 - \sum_{n=1}^{end-1} S * l_i}{v_{end}}$$

Wherein:

T is the delay time when the roller gap of the start variable-thickness stand starts to act relative to the time when the end stand occludes steel;

li is the proportionality factor between the thickness of the strip steel at the outlet of the $i^{th}$ stand and the thickness of the target strip steel; and $v_{end}$ is the velocity of the end stand strip steel at the outlet; when i=end, namely, the end stand is the first stand participating in the variable-thickness control, $$\sum_{n=7}^{6} S * l_i = 0,\ T = \frac{L_1}{v_{end}}$$

In this embodiment, the time at which the F2 starts to act is the time when the F7 stand occludes steel plus the delay:

$$t_n = \frac{L_1 - l_n}{v_{end}} = \frac{50 - 49.7}{5.2} = 0.06\text{s}$$

Step 4 Calculate a variation velocity of the roller gap of each stand participating in the variable-thickness control when controlling the transition section between each equal-thickness section. formula (6) is used to calculate the variation velocity $v_{igk}$ of the roller gap of the $i^{th}$ stand when the target strip steel is transiting from the $k^{th}$ equal-thickness section to the $k+1^{th}$ equal-thickness section:

$$v_{igk} = \frac{(\text{gap}_{ik} - \text{gap}_{i(k+1)}) \times v_i}{L_{gk}} \tag{6}$$

wherein:

$\text{gap}_{ik}$ is the roller gap of the $i^{th}$ stand in the $k^{th}$ equal-thickness section of the target strip steel;

$\text{gap}_{i(k+1)}$ is the roller gap of the $i^{th}$ stand in the $(k+1)^{th}$ equal-thickness section of the target strip steel;

$v_i$ is a moving velocity of the strip steel at the outlet of the $i^{th}$ stand, in m/s; and $L_{gk}$ is a length of the transition section between the $(k+1)^{th}$ equal-thickness section and the $k^{th}$ equal-thickness section.

In this embodiment, the moving velocity of the strip at the outlet of the $i^{th}$ stand may be selected based on the following three cases:

1) when calculating the variation velocity of the roller gap of each stand for the target strip steel in a last transition section, a steel throwing velocity is selected as $v_i$, in this embodiment, it is 8.2 m/s;

2) when calculating the variation velocity of the roller gap of each stand for the target strip steel in other transition sections, a threading velocity is selected as $v_i$, in this embodiment, it is 5.2 m/s;

3) in other cases, adopt an actual moving velocity of the strip steel during rolling as $v_i$.

The depressing/lifting velocity of the roller gap of the transition section between the first equal-thickness section and the second equal-thickness section as well as that of the transition section between the second equal-thickness section and the third equal-thickness section may be calculated according to Table 2, Table 3 and Formula 6. Specific values are given in Table 4.

When the velocity value is positive, it indicates the roller gap is being lifted, while the negative value indicates it is being depressed.

TABLE 4

| depressing/lifting velocity of roller gap in the transition section | F1 | F2 | F3 | F4 | F5 | F6 | F7 |
|---|---|---|---|---|---|---|---|
| Transition section at the head part (mm/s) | 0 | −0.114 | −0.104 | −0.104 | −0.094 | −0.083 | −0.094 |
| Transition section at the end part (mm/s) | 0 | 0.279 | 0.230 | 0.230 | 0.230 | 0.197 | 0.213 |

The actions to control the respective stands in the first transition section are achieved in the sequence below:

1) Based on the previous calculation, the variable-thickness control stands are the F2 stand to the F7 stand. So the F2 stand is the first stand to depress the roller gap of the transition section at the head part. As the previously calculated strip steel distance between the F2 stand and the F7 stand is 49.7 m, the delay time for the F2 stand after the F7 stand occludes steel is calculated as below:

$$t_n = \frac{L_1 - l_n}{v_{end}} = \frac{50 - 49.7}{5.2} = 0.06 \text{ s}$$

Therefore, the F2 starts to depress the roller gap at the velocity of 0.114 mm/s once by deplaying 0.06 second after the F7 stand occludes steel, and the roller gap of the F2 stand is reduced to 13.5 mm from the 14.6 mm in the first equal-thickness section.

2) According to Formula 5, it is known that the roller gap of the F3 stand should be depressed to the exact position where the depressing of the F2 stand is reached, so a delay time is required for the F3 stand relative to the F2 stand. The threading velocity herein is set to 5.2 m/s. Then, the threading velocity of each stand according to the second flow equation is as shown in Table 5 below:

TABLE 5

| | Stand | | | | | | |
|---|---|---|---|---|---|---|---|
| | F1 | F2 | F3 | F4 | F5 | F6 | F7 |
| Threading velocity (m/s) | 1.2 | 1.9 | 2.8 | 3.4 | 4.2 | 4.7 | 5.2 |

Therefore, the delay time is required for the depressing of the roller gap of the F3 stand relative to the depressing of the F2 stand:

$$t_i = \frac{S}{v_{i-1}} = 5.8/1.9 = 3.01 \text{ s}$$

Therefore, the F3 stand starts to depress the roller gap 3.01 s after the F2 stand starts to depress the roller gap. The depressing rate is 0.104 mm/s, and the roller gap of the F3 stand is reduced to 8.9 mm from the 9.9 mm in the first section.

3) Similarly, the F4 stand starts to depress the roller gap 2.1 s after the F3 stand starts to depress the roller gap. The depressing rate is 0.104 mm/s, and the roller gap of the F4 stand is reduced to 7.1 mm from the 8.1 mm in the first section.

4) Similarly, the F5 stand starts to depress the roller gap 1.7 s after the F4 stand starts to depress the roller gap. The depressing rate is 0.094 mm/s, and the roller gap of the F5 stand is reduced to 5.9 mm from the 6.8 mm in the first section.

5) Similarly, the F6 stand starts to depress the roller gap 1.4 s after the F5 stand starts to depress the roller gap. The depressing rate is 0.083 mm/s, and the roller gap of the F4 stand is reduced to 4.6 mm from the 5.4 mm in the first section.

6) Similarly, the F7 stand starts to depress the roller gap 1.2 s after the F6 stand starts to depress the roller gap. The depressing rate is 0.094 mm/s, and the roller gap of the F4 stand is reduced to 4.6 mm from the 5.5 mm in the first section.

7) When the roller gap of the F7 stand is reduced to 4.6 mm, the thick monitoring auto feedback control function AGC is put into operation. At this time, the monitoring AGC performs the monitoring feedback control according to the target thickness 4.6 mm of the second equal-thickness section.

8) When the strip steel is rolled to be $L_1+L_2+L_3-l_2=50+50+400-49.7=450.3$ m, starting from the F2 stand, the roller gap will be lifted from the target roller gap of the second equal-thickness section to the target roller gap of the third equal-thickness section according to the lifting velocity of the roller gap at the end part as given in Table 4.

9) The F3 should start to lift the roller gap after the F2 stands lifts the roller gap by a delay time. As the velocity has nearly reached the threading velocity, the delay time for each stand should be calculated approximately using the threading velocity. The calculated threading velocity of each stand according to the threading velocity of 8.2 m/s is given in Table 6 below:

TABLE 6

| | Stand | | | | | | |
|---|---|---|---|---|---|---|---|
| | F1 | F2 | F3 | F4 | F5 | F6 | F7 |
| Threading Velocity (m/s) | 1.58 | 2.56 | 3.95 | 5.07 | 6.34 | 7.30 | 8.2 |

The delay time is required for the F3 stand to start to lift the roller gap with respect to the F2 stand:

$$t_i = \frac{S}{v_{i-1}} = 5.8/2.56 = 2.27 \text{ s}$$

Therefore, the F3 stand lifts the target roller gap in the second equal-thickness section to the target roller gap in the third equal-thickness section at the lifting velocity for the roller gap of the F3 stand given in Table 4 by delaying 2.27 s after the F2 stand lifts the roller gap at the end part.

10) Similarly, the F4 stand lifts the target roller gap in the second equal-thickness section to the target roller gap in the third equal-thickness section at the lifting velocity for the roller gap of the F4 stand given in Table 4 by delaying 1.47 s after the F3 stand lifts the roller gap.

11) Similarly, the F5 stand lifts the target roller gap in the second equal-thickness section to the target roller gap in the third equal-thickness section at the lifting velocity for the roller gap of the F5 stand given in Table 4 by delaying 1.14 s after the F4 stand lifts the roller gap.

12) Similarly, the F6 stand lifts the target roller gap in the second equal-thickness section to the target roller gap in the third equal-thickness section at the lifting velocity for the roller gap of the F6 stand given in Table 4 by delaying 0.91 s after the F5 stand lifts the roller gap.

13) Similarly, the F7 stand lifts the target roller gap in the second equal-thickness section to the target roller gap in the third equal-thickness section at the lifting velocity for the roller gap of the F7 stand given in Table 4 by delaying 0.79 s after the F6 stand lifts the roller gap.

14) After the F7 stand completes the lifting of the roller gap of the L4 variable-thickness section, the strip steel thickness control performs the control of L5 (the third equal-thickness section). At this time, the monitoring thickness auto feedback control AGC is put into operation, thus the control on the strip with variable thickness in its full length is competed.

Figure 3:
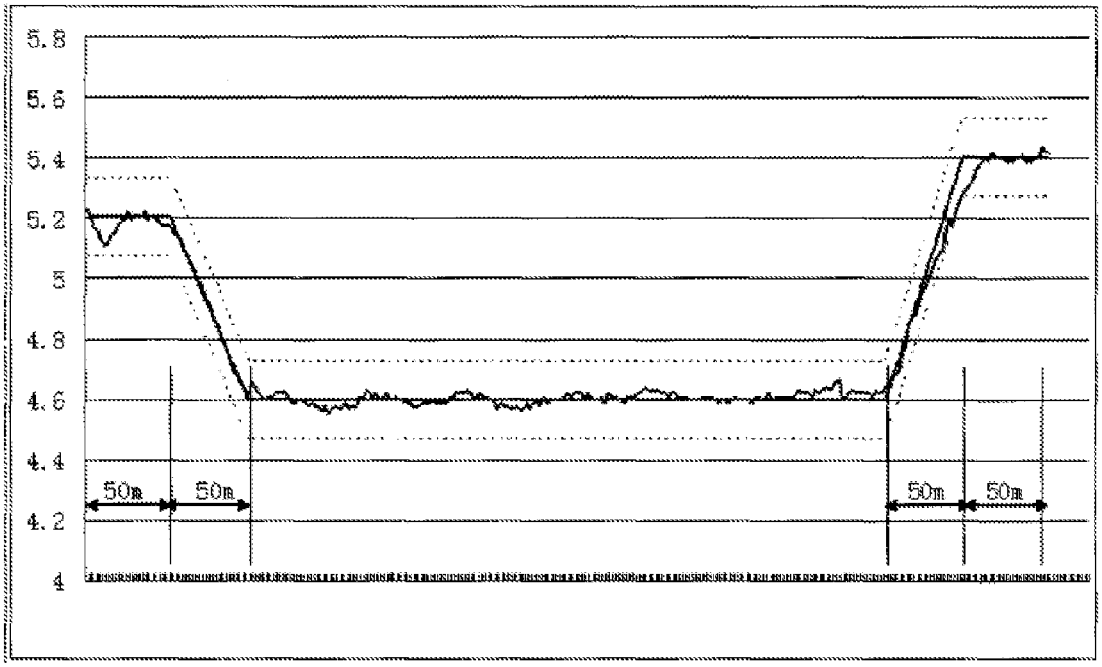
FIG. 3 is the diagram showing the actual performance of the thickness control on the strip steel in its full length in the embodiment. The dotted line indicates the upper and lower limits of control errors; the meander line indicates the actual thickness of the target strip steel and the vertical coordinate indicates the thickness values of the strip steel.

The actual performance diagram of the full-length thickness control for the strip steel, the tested and produced strip steel with different target thicknesses in the longitudinal direction after the production control on the strip steel with different target thicknesses in the longitudinal direction is completed is as shown in FIG. 3. The thickness error of this strip steel meets the requirements.

The invention claimed is:

1. A method for producing a target strip steel with different thicknesses in a longitudinal direction by using a hot continuous rolling mill, comprising:

rolling the target strip steel by two control types, an equal-thickness control and a variable-thickness control;

applying the equal-thickness control for a first equal-thickness section of the target strip steel, wherein the equal-thickness control distributes a load which a plurality of stands bears along a moving direction of the strip steel and in a principle of diminishing load backward from a front stand to next one;

applying the variable-thickness control for other equal-thickness sections and transition sections between equal thickness sections, wherein after occluding occurs at an end stand of the hot continuous rolling mill, wherein applying the variable-thickness control comprises:

determining stands participating in the variable-thickness control, wherein the variable-thickness control is performed by a latter portion of the stands; determining a start stand participating in the variable-thickness control, based on a length of the first equal-thickness section of the strip steel, a target thickness variation amount of each equal-thickness section, and a distance between stands and a rolling stability;

determining a load of each stand participating in the variable-thickness control; distributing a load variation amount in an equal proportion, based on a variation between a load of each stand in a former equal-thickness process and a load of each stand in a later equal-thickness section; and calculating a roller gap value of each stand corresponding to a target thickness of each equal-thickness section, according to a conversion relation between a load and the roller gap;

determining an action timing sequence of each stand participating in the variable-thickness control; calculating a time during which each stand participating in the variable-thickness control changes the roller gap; making each stand performs on a same position of the target strip steel when the roller gap is in change; and calculating a variation velocity of the roller gap of each stand participating in the variable-thickness control when controlling each transition section between equal-thickness sections; completing a production control for the target strip steel with different thicknesses in the longitudinal direction.

2. The method of claim 1, wherein determining the stands participating in the variable-thickness control comprises:

selecting a stand satisfying Formula (1) as the start stand I participating in the variable-thickness control:

$$I = \min\left\{ i,\ i \in \frac{S \times \sum_{n=i}^{(end-1)} h_n}{h_{end}} \le L_1 \right\} \tag{1}$$

wherein: $h_n$ is a thickness of the strip steel at an outlet of the $i^{th}$ stand;

i is a serial number of the stand;

end is the serial number of the end stand of the hot continuous rolling mill;

$L_1$ is the length of the first equal-thickness section;

S is a distance from the $i^{th}$ stand to the $(i+1)^{th}$ stand, and a distance between stands of the hot continuous rolling mill is a constant; and $h_{end}$ is a thickness of the strip steel at the outlet of the end stand;

the stands participating in the variable-thickness control include the $i^{th}$ stand to the end stand; for consideration of rolling stability, the stands participating in the variable-thickness control start to operate after steel occluding occurs at the end stand.

3. The method of claim 2, wherein the stand with a smallest serial number among all the stands satisfying Formula (1) is selected as the start stand.

4. The method of claim 1, wherein calculating a load of each stand participating in the variable-thickness control in the $k^{th}$ equal-thickness section of the target strip steel satisfies Formula (2):

$$T_{ik} = T_{i(k-1)} \times r \tag{2}$$

wherein: $T_{ik}$ is a load of the $i^{th}$ stand in the $k^{th}$ equal-thickness section of the target strip steel;

$T_{i(k-1)}$ is a load of the $i^{th}$ stand in the $(k-1)^{th}$ equal-thickness section of the target strip steel;

$T_{i1}$ is an initial load of the $i^{th}$ stand in the first equal-thickness section; and r is a variation factor of a load transiting from the $(k-1)^{th}$ equal-thickness section to the $k^{th}$ equal-thickness section, and satisfies Formula (3):

$$h_{endk} = h_{(i-1)k} \times \prod_{n=1}^{end} (1 - T_{n(k-1)} \times r) \tag{3}$$

wherein: $h_{endk}$ is a thickness of the strip steel at the outlet of the end stand in the $k^{th}$ equal-thickness section;

$h_{(i-1)k}$ is a thickness of the strip steel at an inlet of the $i^{th}$ stand in the $k^{th}$ equal-thickness section;

$T_{n(k-1)}$ is a load of the ith stand in the (k−1)th equal-thickness section of the target strip steel, n=1, 2, . . . , i;

end is a total number of the stands in the hot continuous rolling mill; and

I is the start stand participating in the variable-thickness control.

5. The method of claim 1, wherein calculating the time during which each stand participating in the variable-thickness control changes the roller gap satisfies Formula (5):

$$t_i = \frac{S}{v_{(i-1)}} \tag{5}$$

wherein: $t_i$ is a delay time of the $i^{th}$ stand lifting and depressing the roller gap relative to the $(i+1)^{th}$ stand;

$v_{(i-1)}$ is a moving velocity of the strip steel at the inlet of the $i^{th}$ stand, in m/s; and S is a distance from the $i^{th}$ stand to the $(i+1)^{th}$ stand, and a distance between stands of the hot continuous rolling mill is a constant;

a roller gap action of the $(i+1)^{th}$ stand starts based on the roller gap action of the $i^{th}$ stand by delaying $t_i$, so as to ensure each stand performs on the same position of the strip steel when each stand performs roller gap change.

6. The method of claim 1, wherein calculating the variation velocity of the roller gap of each stand participating in the variable-thickness control when controlling each transition section between equal-thickness sections satisfies formula (6), and the variation velocity $v_{igk}$ is the variation velocity of the roller gap of the $i^{th}$ stand when the target strip steel is transiting from the $k^{th}$ equal-thickness section to the $k+1^{th}$ equal-thickness section:

$$v_{igk} = \frac{(gap_{ik} - gap_{i(k+1)}) \times v_i}{L_{gk}} \tag{6}$$

wherein: $gap_{ik}$ is the roller gap of the $i^{th}$ stand in the $k^{th}$ equal-thickness section of the target strip steel;

$gap_{i(k+1)}$ is the roller gap of the $i^{th}$ stand in the $(k+1)^{th}$ equal-thickness section of the target strip steel;

$v_i$ is a moving velocity of the strip steel at the outlet of the $i^{th}$ stand, in m/s; and $L_{gk}$ is a length of the transition section between the $(k+1)^{th}$ equal-thickness section and the $k^{th}$ equal-thickness section.

7. The method of claim 6, wherein the moving velocity of the strip at the outlet of the $i^{th}$ stand is selected based on the following three cases:

1) when calculating the variation velocity of the roller gap of each stand for the target strip steel in a last transition section, a steel throwing velocity is selected as $v_i$;
2) when calculating the variation velocity of the roller gap of each stand for the target strip steel in other transition sections, a threading velocity is selected as $v_i$;
3) in other cases, $v_i$ adopts an actual moving velocity of the strip steel during rolling.

* * * * *